US008568901B2

(12) United States Patent
Kiser et al.

(10) Patent No.: US 8,568,901 B2
(45) Date of Patent: Oct. 29, 2013

(54) FILLER METAL COMPOSITION AND METHOD FOR OVERLAYING LOW NOX POWER BOILER TUBES

(75) Inventors: Samuel D. Kiser, Lenoir, NC (US); Brian A. Baker, Kitts Hill, OH (US)

(73) Assignee: Huntington Alloys Corporation, Huntington, WV (US)

( * ) Notice: Subject to any disclaimer, the term of this patent is extended or adjusted under 35 U.S.C. 154(b) by 1207 days.

(21) Appl. No.: 11/942,252

(22) Filed: Nov. 19, 2007

(65) Prior Publication Data

US 2008/0241580 A1 Oct. 2, 2008

Related U.S. Application Data

(60) Provisional application No. 60/860,321, filed on Nov. 21, 2006.

(51) Int. Cl.

| | |
|---|---|
| ***B32B 1/08*** | (2006.01) |
| ***B32B 15/04*** | (2006.01) |
| ***B32B 15/18*** | (2006.01) |
| ***B32B 15/20*** | (2006.01) |
| ***F22B 37/10*** | (2006.01) |
| ***C22C 19/05*** | (2006.01) |
| ***C22C 30/00*** | (2006.01) |
| ***B21D 39/00*** | (2006.01) |
| ***B23K 35/22*** | (2006.01) |
| ***B23K 101/06*** | (2006.01) |

(52) U.S. Cl.

USPC ..... 428/680; 428/34.1; 428/679; 428/639; 228/155; 420/443; 420/584.1; 75/302; 219/146.23; 219/146.24; 122/235.11; 122/235.14

(58) Field of Classification Search

USPC ..... 428/679, 678, 680, 34.1, 639

See application file for complete search history.

(56) References Cited

U.S. PATENT DOCUMENTS

| | | | |
|---|---|---|---|
| 3,865,581 | A | 2/1975 | Sekino et al. |
| 3,874,938 | A | 4/1975 | Benjamin et al. |

(Continued)

FOREIGN PATENT DOCUMENTS

| | | | |
|---|---|---|---|
| CN | 1386877 | A | 12/2002 |
| EP | 0909830 | A1 | 4/1999 |

(Continued)

OTHER PUBLICATIONS

Viswanathan, R. et al., "Boiler Materials for Ultra-Supercritical Coal Power Plants—Steamside Oxidation", Journal of Materials Engineering and Performance, Jun. 2006, pp. 255-274, vol. 15(3), ASM International.

*Primary Examiner* — Michael La Villa
(74) *Attorney, Agent, or Firm* — The Webb Law Firm

(57) ABSTRACT

An alloy for use as a welding overlay for boiler tubes in a low $NO_x$ coal-fired boiler comprising in % by weight: 36 to 43% Cr, 0.2 to 5.0% Fe, 0-2.0% Nb, 0-1% Mo, 0.3 to 1% Ti, 0.5 to 2% Al, 0.005 to 0.05% C, 0.005 to 0.020% (Mg+Ca), 0-1% Mn, 0-0.5% Si, less than 0.01% S, balance substantially Ni and trace additions and impurities. The alloy provides exceptional coal ash corrosion resistance in low partial pressures of oxygen. The alloy also increases in hardness and in thermal conductivity at service temperature over time. The increased hardness improves erosion resistance of the tubes while the increased thermal conductivity improves the thermal efficiency of the boiler and its power generation capabilities.

11 Claims, 7 Drawing Sheets

(56) References Cited

U.S. PATENT DOCUMENTS

| | | | | | |
|---|---|---|---|---|---|
| 4,010,309 | A | * | 3/1977 | Petersen | 428/386 |
| 4,025,314 | A | | 5/1977 | Sadowski et al. | |
| 4,400,209 | A | | 8/1983 | Kudo et al. | |
| 4,662,920 | A | | 5/1987 | Coupland et al. | |
| 5,543,109 | A | | 8/1996 | Senba et al. | |
| 5,958,332 | A | * | 9/1999 | Hoeg | 420/442 |
| 6,106,643 | A | | 8/2000 | Suarez et al. | |
| 2005/0045251 | A1 | | 3/2005 | Nishiyama et al. | |
| 2005/0158203 | A1 | | 7/2005 | Sugahara | |

FOREIGN PATENT DOCUMENTS

| | | | | |
|---|---|---|---|---|
| JP | 2185961 | A | | 7/1990 |
| JP | 6128671 | A | | 5/1994 |
| JP | 7011366 | A | | 1/1995 |
| JP | 7070680 | A | | 3/1995 |
| JP | 93616 | A | | 1/1997 |
| JP | 09-052194 | | * | 2/1997 |
| JP | 9108888 | A | | 4/1997 |
| JP | 2001239396 | A | | 9/2001 |
| JP | 2008115443 | A | | 5/2008 |

* cited by examiner

FILLER METAL COMPOSITION AND METHOD FOR OVERLAYING LOW NOX POWER BOILER TUBES

CROSS-REFERENCE TO RELATED APPLICATION

This application claims the benefit of U.S. Provisional Patent Application No. 60/860,321 filed Nov. 21, 2006, which is incorporated herein in its entirety.

BACKGROUND OF THE INVENTION

1. Field of the Invention

The present invention relates to a nickel, chromium, iron, aluminum, niobium, titanium welding alloy, articles made therefrom for use in producing weldments, and weldments and methods for producing these weldments. The present invention relates to Ni—Cr alloys useful as weld overlays applied for the purpose of enhancing corrosion resistance and, more particularly, where corrosion resistance in his temperature sulfidizing-oxidizing environments is a life-limiting factor.

2. Description of Related Art

In various welding applications including boiler waterwall tubing and reheater and superheater tubing, weld overlays are required to provide long-term corrosion resistance including resistance to corrosion fatigue cracking. The types of resistance requirements include sulfidation, carburization and coal ash corrosion resistance over a range of temperatures of 700° F. through 1450° F., which includes service in ultra-supercritical environments.

Prior to the initiation of NOx (oxides of nitrogen) control, boiler waterwalls did not require weld overlay and performed well when low alloy steels containing small amounts of chromium and sometimes molybdenum were used. Likewise, high-carbon austenitic stainless steel superheater and reheater tubes often performed well before the advent of low NOx boilers.

When environmental concerns dictated the need to reduce NOx emissions, coal-burning power plants began to install low-NOx burners and rationed the overall amount of air used for combustion. This resulted in a reducing environment firing condition within these boilers, the formation of $H_2S$ instead of $SO_2$, and greatly increased corrosion rates of the boiler tubes. Protective weld metal overlays were chosen to extend the lives of both waterwall tubes and superheater and reheater tubes. Generally, overlays deposited with nickel-chromium-molybdenum alloy welding products were used until corrosion-fatigue failures became evident.

The next generation of weld overlays to be used was the molybdenum-free, nickel-chromium alloys that contained between 30-44% chromium. Superheater and reheater tubes seem to be performing well with 40-44% chromium-balance nickel overlays even in slightly reducing, carburizing and sulfidizing environments created by "supertuning". However, waterwall tubes exposed to sulfidation in lower partial pressures of oxygen required greater protection during the most heavily reducing burn times. The present invention improves upon the current 40-44% chromium-balance nickel materials via additions of aluminum in the range of 0.5% to 2.0% and niobium in the range of up to 2%, in the interest of providing additional enhancements to corrosion resistance while maintaining the same degree of fabricability and usability as currently available materials.

Given the combination of high chromium content with added aluminum, with a nickel base, the alloy material of the invention is expected to find application for environments requiring resistance to metal dusting corrosion as well. Applications associated with production of syngas, consisting primarily of hydrogen and carbon monoxide, will be of primary interest.

The present invention overcomes the limitations of the prior art by providing a nickel, chromium, iron, niobium, titanium, aluminum welding alloy and weldments made therefrom that provide the desired corrosion resistance in addition to resistance to hot cracking, as well as corrosion fatigue cracking. The present invention further provides a welding alloy of the nickel, chromium, iron, titanium, aluminum type that is particularly adapted for use in fabricating equipment used in low NOx, coal-fired power generation.

It is a specific object of the present invention to provide a nickel, chromium, iron, titanium, aluminum welding alloy and weldments made therefrom that provide desired resistance to corrosion and corrosion fatigue under conditions of low partial-pressures of oxygen.

A further object of the invention is to provide a welding alloy of the nickel, chromium, aluminum type that is particularly adapted to fabricating and overlaying equipment, such as tubes, used in low NOx coal-fired power boilers.

SUMMARY OF THE INVENTION

In accordance with the invention, there is provided a nickel, chromium, iron, titanium, aluminum alloy for use in producing weld deposits. The alloy comprises, in weight percent, about 36-43% chromium, about 0.5-2.0% aluminum, about 0-2.0% Nb, about 0-1.0% Mo, about 0.2-5.0% iron, about 0.3-1.0% titanium, about 0.005-0.05% carbon, less than 0.50% silicon, preferably 0.10-0.30% silicon, less than 0.01% sulfur, less than 0.02% phosphorus, about 0.005-0.020% magnesium plus calcium and the balance substantially nickel and incidental impurities.

The alloy exhibits adequate corrosion resistance in view of the chromium and aluminum content. The alloy may be in the form of a weld deposit, a welding electrode, a welding electrode in the form of a wire with a flux cover, a welding electrode in the form of a sheath with a flux core, a weld deposit overlay or a weldment comprising an alloy substrate, such as steel with an overlay of the alloy of the invention. It may be used in a method for producing a weld deposit or weldment in the form of a flux-covered electrode used for producing a weld deposit that includes welding performed by submerged arc welding or electroslag welding. The weldment may be in the form of weld-overlaid superheater, reheater, or waterwall tubes of a fossil fuel-fired power generation boiler. It may be further used as an article for producing a weldment, with the article being in the form of welding wire, strip, sheet rod, electrode, prealloyed powder, or elemental powder. The method for producing the weld deposit may include producing a flux-covered electrode of a nickel, chromium wire, or a nickel, chromium, iron wire and melting the electrode to produce a weld deposit.

DETAILED DESCRIPTION OF TEE INVENTION

The NiCrFeAlNbTi welding alloy in accordance with the invention has sufficient chromium and aluminum along with tight control of secondary and trace elements to provide suitable corrosion resistance to sulfidation, carburization, and coal ash conditions as well as resistance to corrosion fatigue. In addition, the alloy has good weldability and resistance to solidification cracking during welding.

To confer resistance to solidification cracking, the alloy should have adequate solubility for its alloying elements and a narrow liquidus to solidus temperature range. Also, it should have low levels of sulfur, phosphorus, and other low-melting elements and it should contain minimum levels of elements that form low-melting point phases in the alloy. Because the very high chromium content challenges the limit of solubility in nickel, careful control of sulfur, magnesium and calcium is required for solidification cracking resistance, also.

Table I shows the composition of the alloys in the present invention that have been exposed to laboratory corrosion testing in which conditions were varied from oxidizing-sulfidizing (4 days per cycle) to oxidizing (3 days per cycle) at 1000° F. Table II shows the composition of alloys tested which lie outside the present invention. Table III shows the gaseous constituents of the environments to which the samples were exposed.

TABLE III

| | Oxidizing-Sulfidizing | | Oxidizing | |
|---|---|---|---|---|
| | Inlet | Outlet | Inlet | Outlet |
| $N_2$ | 67 | 67.2 | 72 | 72 |
| $CO_2$ | 16 | 19.4 | 17.2 | 17.2 |
| $H_2O$ | 10 | 6.8 | 10.75 | 10.75 |
| CO | 5 | 1.45 | | |
| $H_2S$ | 2 | 1.97 | | |
| $H_2$ | | 3 | | |
| $pS_2$ | | 2.07E−08 | | |
| $pO_2$ | | 1.64E−28 | | 3.10E−10 |

Figure 1:
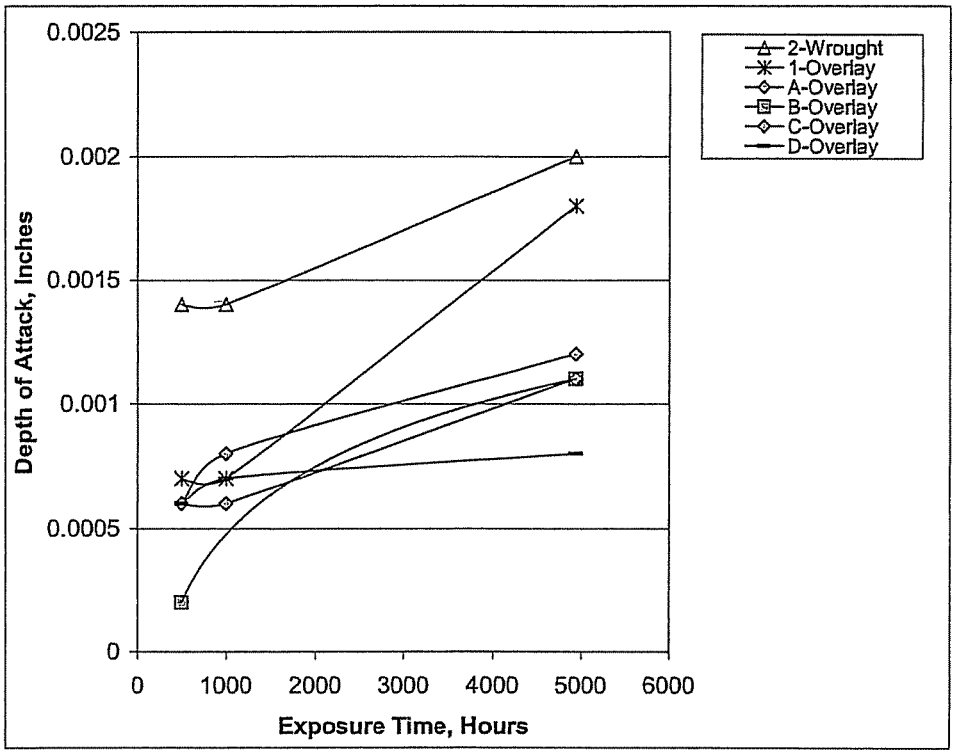
FIG. 1 is a graph showing depth of attack after exposure in simulated low-NOx boiler environment with alternating oxidizing-sulfidizing and oxidizing cycles for alloys of the present invention and comparative alloys.
Figure 2:
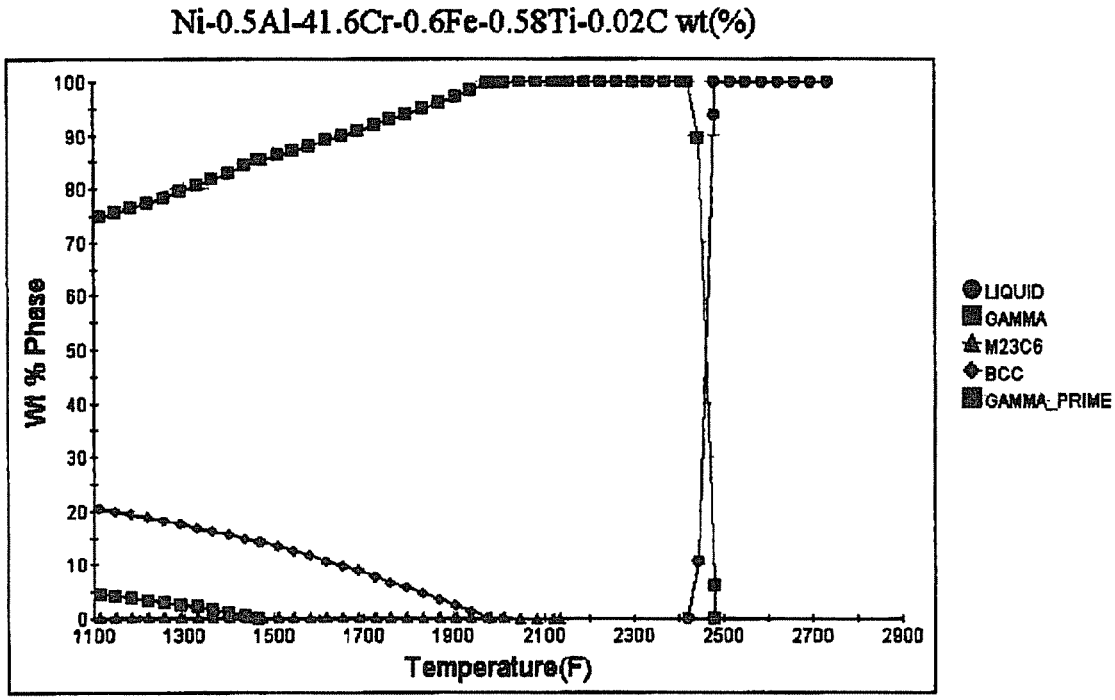
FIG. 2 is a phase stability diagram prediction for alloy A of the present invention.
Figure 3:
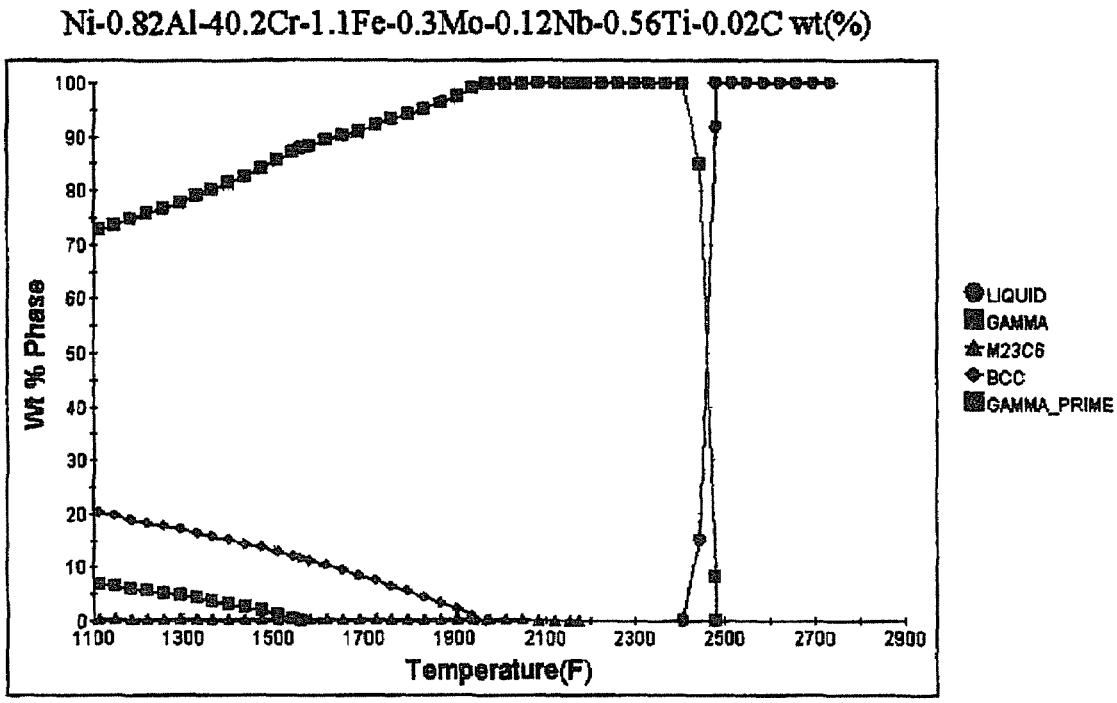
FIG. 3 is a phase stability diagram prediction for alloy B of the present invention.
Figure 4:
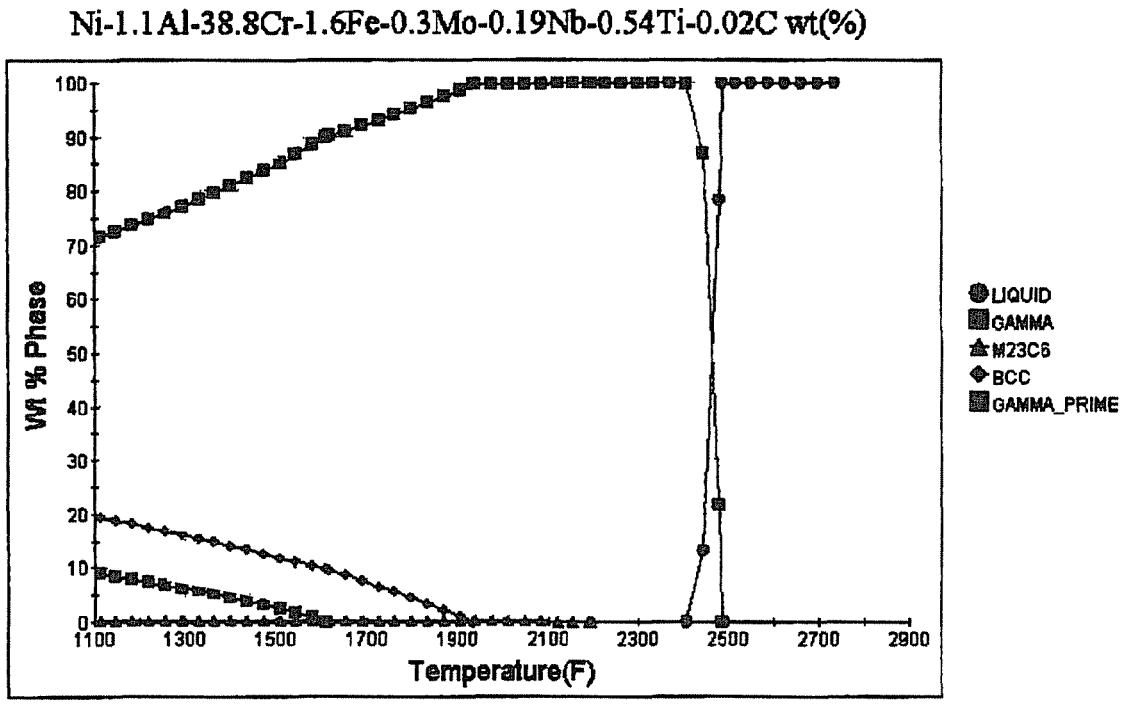
FIG. 4 is a phase stability diagram prediction for alloy C of the present invention.
Figure 5:
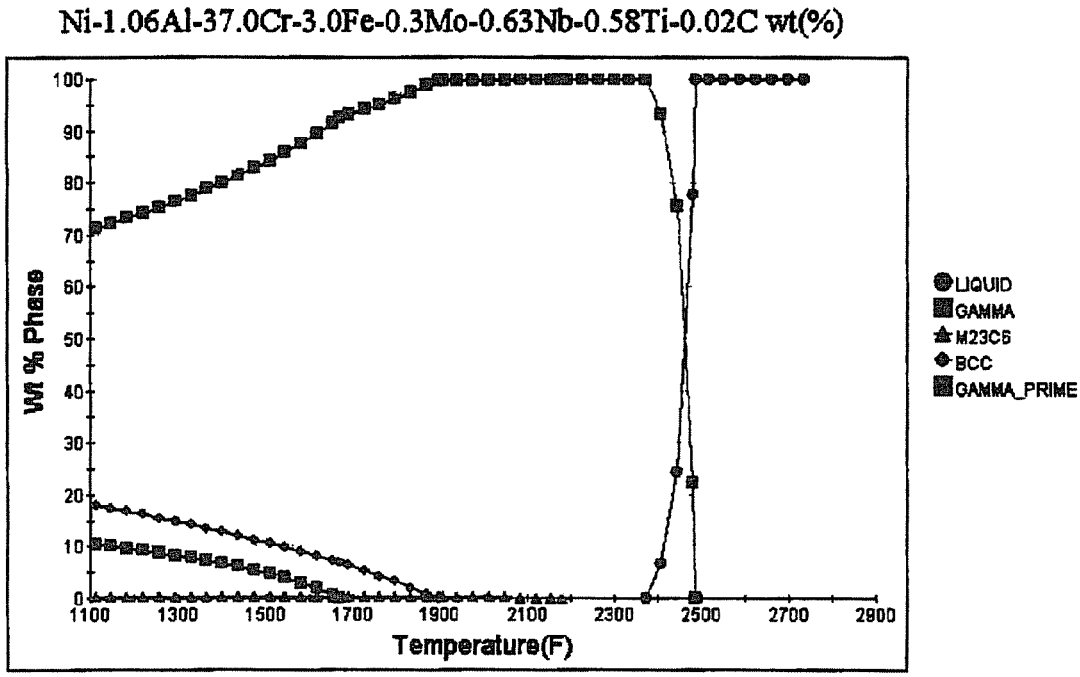
FIG. 5 is a phase stability diagram prediction for alloy D of the present invention.
Figure 6:
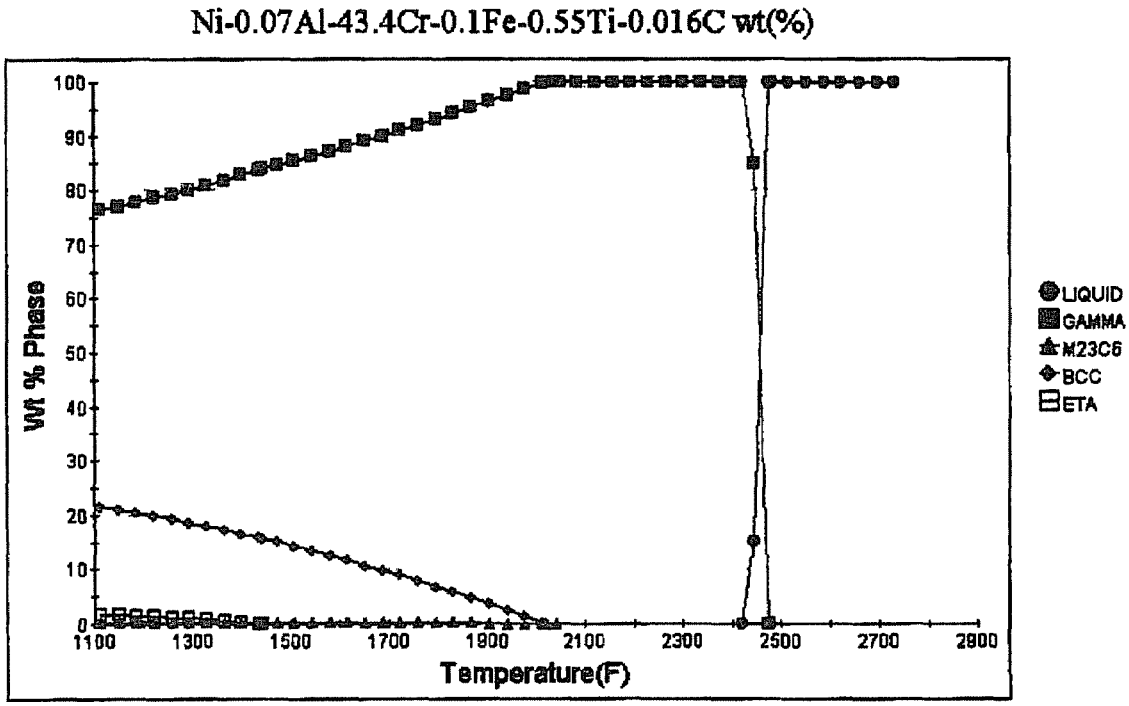
FIG. 6 is a phase stability diagram prediction for alloy 1 of the present invention.

FIG. 1 compares depth of attack as a function of time up to a total testing duration of 4940 hours. With the exception of alloy 2, all materials were tested in the form of weld overlays. Weld deposits were made onto carbon steel using the Gas Tungsten Arc Welding (GTAW) process. Note that corrosion rates were lowest among the high chromium-containing nickel alloys and very lowest among the alloys containing the highest Al level. Alloys A, B, C and D of the present invention exhibit improved performance over the others tested. FIGS. 2 through 6 show phase diagram predictions for these alloys, in addition to alloy 1, performed using JmatPro® by Sente Software. The alpha chromium (notated BCC in the figures) solvus temperature of alloys A, B, C and D does not exceed that of alloy 1, which is currently commercially produced. Also, the gamma prime fraction and solvus are not so excessively high as to interfere with thermal processing. Alloy D, containing niobium, shows particular promise with respect to the corrosion results (FIG. 1), as the attack rate trend exhibits a flatter profile than that of the other materials and the depth of attack is lowest overall for this material.

Figure 7:
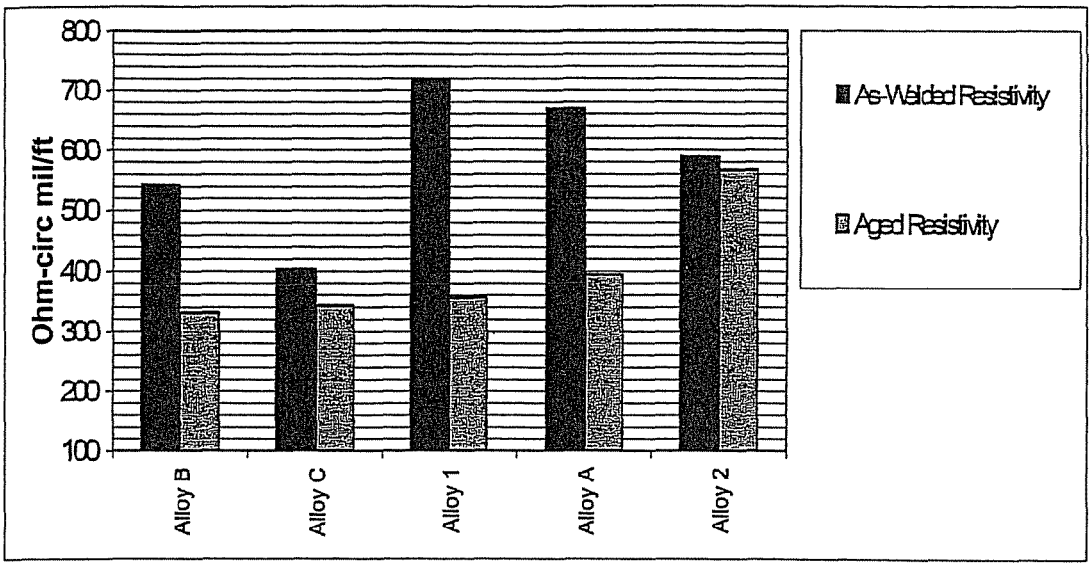
FIG. 7 is a graph showing measured room temperature electrical resistivity values in the as-welded and 1000° F./4940 h aged conditions for weld overlays fabricated on carbon steel using alloys 1, 2, A, B and C.
Figure 8:
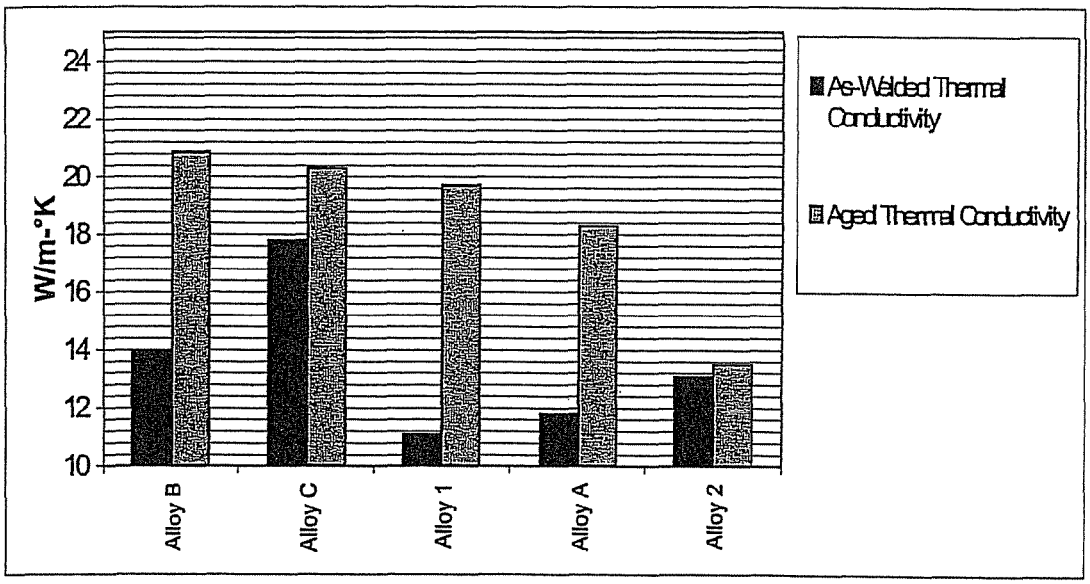
FIG. 8 is a graph showing interpolated room temperature thermal conductivity values in the as-welded and 1000° F./4940 h aged conditions for weld overlays fabricated on carbon steel using alloys 1, 2, A, B and C.

FIG. 7 shows electrical resistivity values at room temperature for alloys 1, 2, A, B and C. Alloys 1, A, B and C exhibit much lower electrical resistivity than alloy 2, which is currently used for application of weld overlays in low-NOx boiler waterwalls. As electrical resistivity is known to be inversely proportional to thermal conductivity, lowering of electrical resistivity should result in a commensurate increase in thermal conductivity. FIG. 8 shows interpolated thermal

TABLE I

Composition of Alloys in the Present Invention (weight %)

| Alloy | C | Ni | Cr | Fe | Mo | Nb | W | Al | Ti | Mg | Ca | Mn | Si |
|---|---|---|---|---|---|---|---|---|---|---|---|---|---|
| A | 0.020 | 56.4 | 41.6 | 0.6 | | 0.06 | | 0.50 | 0.58 | 0.0048 | 0.0045 | 0.03 | 0.1 |
| B | 0.020 | 56.9 | 40.2 | 1.1 | | 0.12 | | 0.82 | 0.56 | 0.0046 | 0.004 | 0.04 | 0.09 |
| C | 0.020 | 57.4 | 38.8 | 1.6 | | 0.19 | | 1.10 | 0.54 | 0.0043 | 0.0035 | 0.06 | 0.086 |
| D | 0.020 | 57.0 | 37.0 | 3.0 | 0.3 | 0.63 | | 1.06 | 0.58 | 0.004 | 0.0032 | 0.06 | 0.08 |

TABLE II

Composition of Alloys Outside the Present Invention (weight %)

| Alloy | C | Ni | Cr | Fe | Mo | Nb | W | Al | Ti | Mg | Ca | Mn | Si |
|---|---|---|---|---|---|---|---|---|---|---|---|---|---|
| 1 | 0.016 | 55.9 | 43.4 | 0.1 | | | | 0.07 | 0.55 | 0.009 | 0.007 | 0 | 0.1 |
| 2 | 0.004 | 59.3 | 20.4 | 2.3 | 14.1 | 0.04 | 3.1 | 0.25 | 0.06 | 0.007 | 0.0001 | 0.2 | 0.05 |

conductivity values, based upon the electrical resistivity values shown in FIG. 7, and known values of electrical resistivity and thermal conductivity for a range of nickel-base materials. This characteristic could be advantageous for an overlay material, as the surface temperature in service would be effectively lower and the boiler could operate more efficiently by virtue of improved heat transfer across the boiler tube wall. This improved thermal conductivity would offer several advantages when the alloy is used as an overlay. Because corrosion rate is usually proportional to surface temperature, higher thermal conductivity would allow superheated steam to be produced at the design temperature while the overlay surface operated at lower temperature than that of corresponding tubes overlaid with materials of lower thermal conductivity. At the same time, higher thermal conductivity of the overlay provides for higher overall boiler thermal efficiency.

Because chromium in a nickel matrix provides outstanding resistance to sulfidation and vanadium accelerated oxidation attack due to a chromia-rich adherent layer formed in service, the high-chromium nickel alloys of 36-43% Cr perform satisfactorily in environments that contain more than a partial pressure of about $10^{-38}$ atmosphere partial pressure of oxygen, typical of a conventional coal-fired boiler but not likely present beneath the coal ash of a low $NO_x$ boiler. In environments with lower partial pressures of oxygen, the high chromium nickel alloys heretofore used develop less protective oxide scales that have been found to exhibit reduced sulfidation resistance. On the other hand, the alloy of the present invention shows that with a small addition of about 0.5% to 2% Al, the protection afforded by the known high chromium nickel alloys can be extended to environments exhibiting even lower partial pressures of oxygen as is present beneath the coal ash found to coat typical coal-fired boiler tubes. See Table IV, below.

TABLE IV

Mass change data (mg/cm$^2$) and depth of attack (inches) after 4940 hours at 538° C. in a simulated flue gas environment alternating 4 days reducing (67% $N_2$ - 16% $CO_2$ - 5% CO - 10% $H_2O$ - 2% $H_2S$) and 3 days oxidizing (72% $N_2$ - 71.2% $CO_2$ - 10.8% $H_2O$).

| Alloy (overlay) | Mass Change (mg/cm$^2$) | Depth of Attack (inches) |
|---|---|---|
| FM 72 | 5.88 | 0.0018 |
| A | 5.33 | 0.0012 |
| B | 4.88 | 0.0011 |
| C | 3.42 | 0.0011 |
| D | 3.59 | 0.0008 |

In addition, the thermal conductivity of these alloys as weld overlays has been found to increase with time as the result of the precipitation of alpha chromium and the onset of a nickel-chromium ordering reaction. This enhancement of thermal conductivity improves the overall efficiency of the coal-fired power plant resulting in benefits to power providers, their customers and even the environment. The enhancement of the thermal conductivity over time under service conditions at 538° C. is presented in Table V, below.

TABLE V

Room Temperature Thermal Conductivity of As-Produced and As-Aged (538° C./4940 hours) Alloys of This Patent Disclosure

| Alloy (overlay) | As-Produced Thermal Conductivity (W/m/° K) | As-Aged Thermal Conductivity 538° C./1000 hours (W/m° K) |
|---|---|---|
| FM 72 | 11.5 | 17.4 |
| A | 11.8 | 18.1 |
| B | 14.0 | 20.9 |
| C | 17.8 | 20.3 |

The as-deposited overlay hardness allows for tube bending and field fabrication. In addition, the ordering and alpha chromium precipitation reactions that occur at the typical surface temperatures found on the waterwall, superheater and reheater boiler tubing increase the hardness of the weld overlay and thus provide improved erosion resistance for the boiler tubing, as reported below in Table VI. The hot workability of the alloy range has been improved by the use of a Mg and Ca deoxidation treatment as described in U.S. Pat. No. 6,106,643 to Suarez et al.

TABLE VI

Hardness of the Alloy Overlays as Produced and After Aging at 538° C. for 4940 Hours

| Alloy (overlay) | As-Produced Hardness ($R_b$) | As-Aged Hardness ($R_c$) |
|---|---|---|
| FM 72 | 87 | 41 |
| A | 84 | 30 |
| B | 83 | 31 |
| C | 85 | 38 |

As reported above in Tables I-VI, the alloy of the present invention provides a weld overlay alloy for boiler tubes having enhanced coal-ash corrosion resistance under extreme reducing conditions, coupled with increasing thermal conductivity and hardness with time at service temperature in a coal-fired, low NOx boiler environment.

The welding alloy of the invention may be deposited on the boiler tubes by a spiral overlaying technique which in itself is well-known in the art. This technique may utilize a conventional integrated robotic overlay application system employing a plurality of full function robots, power supplies and microprocessor controller hardware to provide consistent weld metal deposition of uniform thickness. The spiral overlaid tubing can be post-weld bent to most any desired boiler layout configuration.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. An alloy suitable for use as a welding overlay for boiler tubes in a low $NO_x$ coal-fired boiler comprising in % by weight: 36 to less than 42% Cr, 0.2 to 5.0% Fe, 0.06 to 2.0% Nb, 0-1% Mo, 0.3 to 1% Ti, 0.5 to 2% Al, 0.005 to 0.05% C, 0.005 to 0.020% (Mg+Ca), 0-1% Mn, 0-0.5% Si, less than 0.01% S, balance substantially Ni and trace additions and impurities.

2. The alloy of claim 1 providing exceptional coal ash corrosion resistance in low partial pressures of oxygen.

3. The alloy of claim 1 in an after-welded state providing increased thermal conductivity at service temperature over time.

4. The alloy of claim 1 in an after-welded state providing increased hardness at service temperature over time.

5. The alloy of claim 1, wherein the alloy comprises in % by weight: 37 to less than 42% Cr, 0.2-4.0% Fe, 0.06-2.0% Nb, 0-1% Mo, 0.3-1.0% Ti, 0.8-1.5% Al, 0.005-0.05% C, 0.1-0.3% Si, 0-0.5% Mn, 0.005-0.020% (Mg+Ca), and balance substantially Ni and incidental impurities.

6. The alloy of claim 5 nominally containing about 0.02% C, 57% Ni, 37% Cr, 3% Fe, 0.3% Mo, 0.6% Nb, 1% Al, 0.6% Ti, 0.007% (Mg+Ca), 0.06% Mn and 0.08% Si.

7. A boiler tube for a coal-fired low $NO_x$ boiler having a weld overlay, wherein the overlay is made from an alloy consisting essentially of, in % by weight: 36 to less than 42% Cr, 0.2 to 5.0% Fe, 0.06-2.0% Nb, 0-1% Mo, 0.3 to 1% Ti, 0.5 to 2% Al, 0.005 to 0.05% C, 0.005 to 0.020% (Mg+Ca), 0-1% Mn, 0-0.5% Si, less than 0.01% S, balance substantially Ni and trace additions and impurities.

8. The boiler tube of claim 7, wherein the weld overlay alloy consists essentially of, in % by weight: 37-41.6% Cr, 0.2-4.0% Fe, 0.6-2.0% Nb, 0-1% Mo, 0.3-1.0% Ti, 0.8-1.5% Al, 0.005-0.05% C, 0.1-0.3% Si, 0-0.5% Mn, 0.005-0.020% (Mg+Ca), and balance substantially Ni and incidental impurities.

9. A welding electrode for depositing as a welding overlay for boiler tubes in a low $NO_x$ coal-fired boiler comprising in % by weight: 36 to 42% Cr, 0.2 to 5.0% Fe, 0.06 to 2.0% Nb, 0-1% Mo, 0.3 to 1% Ti, 0.5 to 2% Al, 0.005 to 0.05% C, 0.005 to 0.020% (Mg+Ca), 0-1% Mn, 0-0.5% Si, less than 0.01% S, balance substantially Ni and trace additions and impurities.

10. The welding electrode of claim 9 comprising in % by weight: 37 to less than 42% Cr, 0.2-4.0% Fe, 0.06-2.0% Nb, 0-1% Mo, 0.3-1.0% Ti, 0.8-1.5% Al, 0.005-0.05% C, 0.1-0.3% Si, 0-0.5% Mn, 0.005-0.020% (Mg+Ca), and balance substantially Ni and incidental impurities.

11. A method for making a weld overlay boiler tube comprising the steps of:

(a) providing a tube;

(b) providing a weld alloy comprising in % by weight: 36 to less than 42% Cr, 0.2 to 5.0% Fe, 0.06 to 2.0% Nb, 0-1% Mo, 0.3 to 1% Ti, 0.5 to 2% Al, 0.005 to 0.05% C, 0.005 to 0.020% (Mg+Ca), 0-1% Mn, 0-0.5% Si, less than 0.01% S, balance substantially Ni and trace additions and impurities;

(c) applying the weld alloy to the surface of the tube by welding to provide an overlaid tube; and (d) bending the overlaid tube to a desired configuration suitable for installation in the boiler.

* * * * *